US011339804B2

(12) United States Patent
Pohler et al.

(10) Patent No.: US 11,339,804 B2
(45) Date of Patent: May 24, 2022

(54) SELF-CLEANING PUMP

(71) Applicant: Liberty Pumps, Inc., Bergen, NY (US)

(72) Inventors: Donald M. Pohler, North Chili, NY (US); David M. Williams, Attica, NY (US); Brad Sawyer, Hilton, NY (US)

(73) Assignee: Liberty Pumps, Inc., Bergen, NY (US)

( * ) Notice: Subject to any disclaimer, the term of this patent is extended or adjusted under 35 U.S.C. 154(b) by 727 days.

(21) Appl. No.: 16/051,538

(22) Filed: Aug. 1, 2018

(65) Prior Publication Data

US 2020/0040915 A1 Feb. 6, 2020

(51) Int. Cl.

| | |
|---|---|
| ***F04D 29/70*** | (2006.01) |
| ***F04D 7/02*** | (2006.01) |
| ***F04D 29/22*** | (2006.01) |

(52) U.S. Cl.

CPC ..... *F04D 29/708* (2013.01); *F04D 7/02* (2013.01); *F04D 29/22* (2013.01)

(58) Field of Classification Search

CPC ..... F04D 29/708; F04D 7/02; F04D 29/22; F04D 29/2244; F04D 29/086; F04D 29/167; F04D 29/2266; F04D 29/225; F04D 7/04

See application file for complete search history.

(56) References Cited

U.S. PATENT DOCUMENTS 3,155,046 A * 11/1964 Vaughan ..... F04D 29/2288 415/206
3,375,983 A * 4/1968 Von Eiff ..... F04D 11/005 415/121.1
6,139,260 A * 10/2000 Arbeus ..... F04D 29/242 415/121.2
6,224,331 B1 * 5/2001 Hayward ..... F04D 7/045 415/121.1
7,037,069 B2 5/2006 Arnold et al.
9,255,576 B2 2/2016 Adams et al.
9,605,684 B2 * 3/2017 Andersson ..... F04D 29/106
9,835,168 B2 * 12/2017 Uchida ..... E03F 5/22
9,869,326 B2 * 1/2018 Stark ..... F04D 7/04
2014/0308142 A1 * 10/2014 Andersson ..... F16J 15/44 417/423.11
2017/0241424 A1 8/2017 Patil et al.
2018/0051708 A1 2/2018 Kawai et al.
2018/0051718 A1 2/2018 Kawai et al.

* cited by examiner

*Primary Examiner* — Kenneth Bomberg
*Assistant Examiner* — Adam W Brown
(74) *Attorney, Agent, or Firm* — John M. Hammond; Patent Innovations LLC

(57) ABSTRACT

A pump comprising a volute housing, a rotatable shaft, and an impeller. The volute housing comprises a volute cavity side wall, an upper cylindrical wall, and an upper wall. The upper cylindrical wall extends upwardly from an upper perimeter edge and includes an upper recessed notch formed therein. The upper wall extends radially inwardly from the upper cylindrical wall. The rotatable impeller is operatively coupled to the rotatable shaft and comprises a top cylindrical wall and a top flange. The top cylindrical wall extends upwardly from a top perimeter edge of the top flange and includes a top recessed notch formed therein. The top cylindrical wall is separated from the upper cylindrical wall of the volute housing by an upper annular gap. The top recessed notch of the rotatable impeller and the upper recessed notch of the volute housing may be slot-shaped or wedge-shaped.

19 Claims, 12 Drawing Sheets

SELF-CLEANING PUMP

BACKGROUND

Technical Field

Centrifugal pumps, and more particularly, a centrifugal pump including a pump impeller and corresponding volute configured to remove foreign material entrained between them.

Description of Related Art

A typical centrifugal pump is comprised of a rotating body known as an impeller, which rotates within a stationary volume called a volute. Pumps have evolved to encompass a wide range of designs and configurations. However, they share the general objective of moving a liquid from one location to another. The liquid being pumped is not always clear, and of a homogeneous liquid phase. The liquid often contains solid debris. In particular, a sewage pump may encounter solid foreign bodies and materials such as hair, latex, woven cloth material, stones, etc. In the case of an industrial application, any conceivable type of debris may be present in the liquid.

The size of this debris varies as well. For example, it is very common for hand towels or rags, to tiny stones to be present in the process fluid. The various contaminants cause different problems for a pump, and various attempts have been made to solve the problems. For example, a pump might be designed such that the impeller is small in size relative to the volute volume with clearance both axially and radially between the volute and the impeller. This type of design often has lower pumping efficiencies but avoids the problem of jamming by relatively small solid particles becoming caught between the impeller and volute. However, as stated previously the type of contaminants is unpredictable, and certain solid contaminants may still cause jamming of the impeller. For example, a washcloth (mistakenly flushed down a toilet) could ben entrained in the liquid sewage, and become wrapped around the impeller or trapped above it. Such tangled or wrapped up debris may cause the pump seals to leak. Such debris, and other types of debris may impede pump performance, resulting in decreased pumping efficiency, increased heat generation, a stalled pump motor, and other problems.

Centrifugal pumps are inherently inefficient. In an effort to improve pump efficiency, designs have often shifted from open or semi-open impellers to closed impellers. In a closed impeller, the vane is positioned between two flanges that rotate as a unit. The benefit of a closed impeller design is the elimination of slip from one vane to another, as occurs with an open impeller. A disadvantage of a closed impeller design is that a "seal" must be created between the impeller and volute body to prevent leakage of high pressure liquid back to the low pressure upstream side of the impeller, instead of being discharged from the volute and out of the pump. Different attempts have been made to provide sealing between the flanges of a closed impeller and a volute, including lip seals, rubber boots, and rings that run very close to each other and thus limit the amount of leakage that can occur.

When such pumps are used to pump liquids that include solid debris, such solid debris has caused chronic problems. Such pumps with physical seals and/or minimal running clearances between impellers and volutes are prone to having various debris cause interference at the seals and narrow running clearances. Common debris such as hand towels or rags have been known to caused large horsepower pumps to stall on relatively small amounts of fragments that get trapped and wedged between the rotating impeller and stationary volute casing.

In a centrifugal pump with a closed impeller, there remains a need for a combination of pump volute and impeller that operate with high pumping efficiency, while avoiding adverse effects of entrained solid debris in the liquid to be pumped.

SUMMARY

The centrifugal pump of the present disclosure meets this need. The pump may be characterized as having a self-cleaning impeller and volute combination that enables the impeller to run in very close proximity to the volute case in order to maintain efficiency, while also preventing clogging or jamming. In one aspect of the pump, the flanges of the impeller are provided as surfaces parallel to corresponding surfaces in the volute, which promote particle expulsion. Additionally, features are provided in the volute and impeller such that one essentially scrapes the other and expels debris by forcing along a ramp and causing it to be flushed away with the process liquid as it passes through the impeller and pump. Such recessed notch features with ramps are incorporated into both the impeller and volute. Depending on a given particle entrained between the impeller and the volute, the particle it will either rotate temporarily adhered to the impeller and thus be rejected by the cleaning notch in the volute; or the particle will be stationary, adhered to the volute wall, and thus be rejected by the cleaning notch in the impeller.

More particularly, in accordance with the present disclosure, a pump is provided comprising a volute housing, a rotatable shaft, and an impeller. The volute housing comprises a volute cavity side wall, an upper cylindrical wall, a lower cylindrical wall, and an upper wall.

The volute cavity side wall defines a volute cavity, and includes an upper region terminating at an upper perimeter edge and a lower region terminating at a lower perimeter edge. The upper cylindrical wall extends upwardly from the upper perimeter edge and includes an upper recessed notch formed therein. The lower cylindrical wall extends downwardly from the lower perimeter edge and includes a lower recessed notch formed therein. The upper wall extends radially inwardly from the upper cylindrical wall.

The rotatable shaft extends to the upper wall of the volute housing and terminates at a distal end. The rotatable impeller is operatively coupled to the rotatable shaft and has a direction of rotation and an axis of rotation. In some embodiments, the rotatable impeller may be configured as a "closed impeller." In such embodiments, the rotatable impeller comprises a top cylindrical wall and a bottom cylindrical wall. The rotary impeller may be further comprised of an impeller passageway in fluid communication with the volute cavity and includes an axial inlet transitioning to a lateral outlet defined by a side wall, a top flange, and a bottom flange. The top cylindrical wall extends upwardly from a top perimeter edge of the top flange and includes a top recessed notch formed therein. The top cylindrical wall is separated from the upper cylindrical wall of the volute housing by an upper annular gap. The bottom cylindrical wall extends downwardly from a bottom perimeter edge of the bottom flange and includes a bottom recessed notch formed therein.

The bottom cylindrical wall is separated from the lower cylindrical wall of the volute housing by a lower annular gap.

In operation of the pump, rotation of the rotatable shaft causes rotational motion of the top recessed notch of the top cylindrical wall of the impeller past the upper recessed notch of the upper cylindrical wall of the volute housing and rotational motion of the bottom recessed notch of the bottom cylindrical wall of the impeller past the lower recessed notch of the lower cylindrical wall of the volute housing. Such motion of the top recessed notch of the top cylindrical wall of the impeller past the upper recessed notch of the upper cylindrical wall of the volute housing and motion of the bottom recessed notch of the bottom cylindrical wall of the impeller past the lower recessed notch of the lower cylindrical wall of the volute housing results in a shearing action when the notches pass each other. The shearing action has been discovered to be effective in cutting and discharging any debris that becomes entrained in the respective upper and lower annular gaps. This cutting and shearing action in turn is effective in maintaining reliable operation of the pump at high efficiency.

The top and bottom recessed notches of the rotatable impeller and the upper and lower recessed notches of the volute housing may have a variety of shapes. In some embodiments, the notches may be slot-shaped. In other embodiments, the notches may be wedge-shaped. These various notch configurations will be described subsequently herein.

In accordance with the present disclosure, a pump is provided comprising a volute housing, a rotatable shaft, and an impeller formed as an open impeller. The volute housing comprises a volute cavity side wall, an upper cylindrical wall, and an upper wall. The volute cavity side wall defines a volute cavity, and includes an upper region terminating at an upper perimeter edge. The upper cylindrical wall extends upwardly from the upper perimeter edge and includes an upper recessed notch formed therein. The upper wall extends radially inwardly from the upper cylindrical wall. The rotatable shaft extends to the upper wall of the volute housing and terminates at a distal end. The rotatable impeller is operatively coupled to the rotatable shaft and has a direction of rotation and an axis of rotation, and comprises a top cylindrical wall and a top flange. The top cylindrical wall extends upwardly from a top perimeter edge of the top flange and includes a top recessed notch formed therein. The top cylindrical wall is separated from the upper cylindrical wall of the volute housing by an upper annular gap. The top recessed notch of the rotatable impeller and the upper recessed notch of the volute housing may be slot-shaped or wedge-shaped as described above and subsequently herein.

BRIEF DESCRIPTION OF THE DRAWINGS

The present disclosure will be provided with reference to the following drawings, in which like numerals refer to like elements, and in which.

Figure 1:
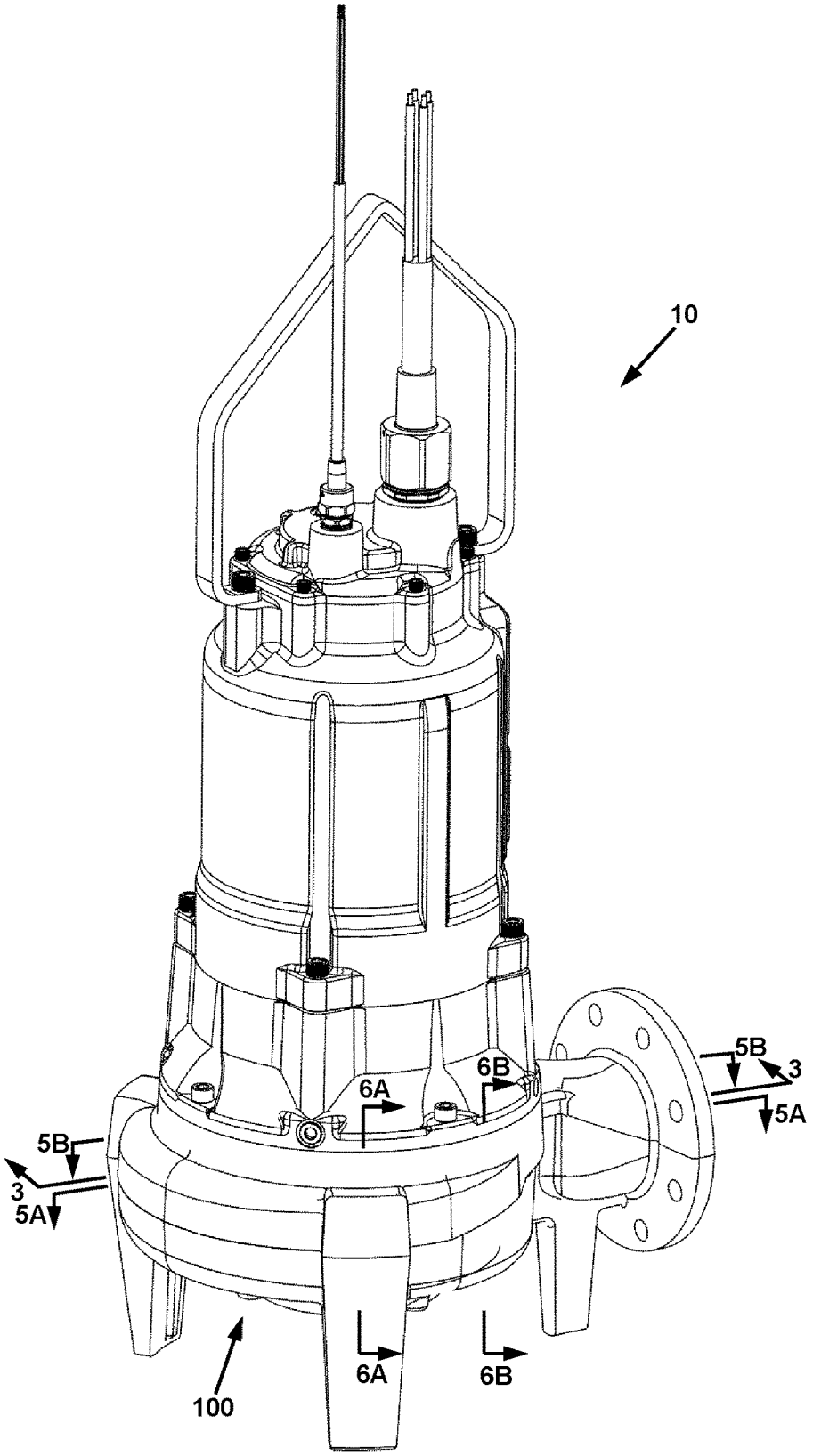
FIG. 1 is a perspective exterior view of a pump in accordance with the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, certain components may be describes with adjectives such as "top," "upper," "bottom," "lower," "left," "right," etc. These adjectives are provided in the context of the orientation of the drawings, which is arbitrary. The description is not to be construed as limiting the pump to use in a particular spatial orientation. The instant pump may be used in orientations other than those shown and described herein.

It is also to be understood that any connection references used herein (e.g., attached, coupled, connected, and joined)

are to be construed broadly and may include intermediate members between a collection of elements and relative movement between elements unless otherwise indicated. As such, connection references do not necessarily imply that two elements are directly connected and in fixed relation to each other.

Turning now to FIGS. 1-7C, a pump 10 of the present disclosure is provided comprising a volute housing 100, a rotatable shaft 50, and an impeller 200. The volute housing 100 comprises a volute cavity side wall 150, an upper cylindrical wall 120, a lower cylindrical wall 170, and an upper wall 110.

The volute cavity side wall 150 defines a volute cavity 155, and includes an upper region 152 terminating at an upper perimeter edge 153 and a lower region 156 terminating at a lower perimeter edge 157. The upper cylindrical wall 120 extends upwardly from the upper perimeter edge 153 and includes an upper recessed notch 160 formed therein. The lower cylindrical wall 170 extends downwardly from the lower perimeter edge 157 and includes a lower recessed notch 180 formed therein. The upper wall 110 extends radially inwardly from the upper cylindrical wall 120.

In the embodiment depicted in FIGS. 1-7C, the rotatable shaft 50 is driven by a motor 20 contained in a housing 30. Other drivers of rotatable shaft 50 are contemplated. The rotatable shaft 50 extends to the upper wall 110 of the volute housing 100 and terminates at a distal end 52. The rotatable impeller 200 is operatively coupled to the rotatable shaft 50 and has a direction of rotation 99 and an axis of rotation 98. In the embodiment depicted in FIGS. 1-7C, the rotatable shaft 50 extends to the upper wall 110 of the volute housing 100, and beyond, with the distal end 52 contained within the volute housing 100. The impeller 200 is mounted on the distal end 52 of the shaft 50. A seal 42 is provided to prevent leakage of liquid to be pumped (not shown) from within the volute housing 100. In certain embodiments, the pump 10 may further include a second seal 44 and a bushing 46. The seals 42 and 44 and bushing 46 may function as disclosed in commonly owned U.S. patent application Ser. No. 14/920,143, the disclosure of which is incorporated herein by reference.

In other embodiments (not shown), the rotatable shaft 50 extends in close proximity to the upper wall 110 of the volute housing 100. A first portion of a magnetic coupling may be mounted on the distal end 52 of the rotatable shaft 50. A corresponding second portion of a magnetic coupling may be joined to the impeller 200. In that manner, rotation of the rotatable shaft 50 causes rotation of the impeller 200. Thus the term "operatively coupled" includes both a direct mounting of the impeller 200 on the shaft 50, and also magnetic coupling of the shaft 50 to the impeller 200. Other operative coupling arrangements are contemplated.

Regardless of the manner in which the rotatable shaft 50 is coupled to the impeller 200, the impeller 200 of FIGS. 1-7 is configured as a closed impeller and comprises a top cylindrical wall 220, and a bottom cylindrical wall 270. The rotary impeller may be further comprised of an impeller passageway 255 in fluid communication with the volute cavity 155 and includes an axial inlet 251 transitioning to a lateral outlet 252 defined by a side wall 254, a top flange 256, and a bottom flange 258. The top cylindrical wall 220 extends upwardly from a top perimeter edge 257 of the top flange 256 and includes a top recessed notch 260 formed therein. The top cylindrical wall 220 is separated from the upper cylindrical wall 120 of the volute housing by an upper annular gap 221. The bottom cylindrical wall 270 extends downwardly from a bottom perimeter edge 259 of the bottom flange 258 and includes a bottom recessed notch 280 formed therein. The bottom cylindrical wall 270 is separated from the lower cylindrical wall 170 of the volute housing 100 by a lower annular gap 271.

In operation of the pump 10, rotation of the rotatable shaft 50 causes rotational motion of the top recessed notch 260 of the top cylindrical wall 220 of the impeller 200 past the upper recessed notch 160 of the upper cylindrical wall 120 of the volute housing 100 and rotational motion of the lower recessed notch 280 of the bottom cylindrical wall 270 of the impeller 200 past the lower recessed notch 180 of the lower cylindrical wall 170 of the volute housing 100. Such motion of the top recessed notch 260 of the top cylindrical wall 220 of the impeller 200 past the upper recessed notch 160 of the upper cylindrical wall 120 of the volute housing 100 and motion of the bottom recessed notch 280 of the bottom cylindrical wall 270 of the impeller 200 past the lower recessed notch 180 of the lower cylindrical wall 170 of the volute housing 100 results in a shearing action when the respective notch pairs 160/260 and 180/280 pass each other. The shearing action has been discovered to be effective in cutting and discharging any debris that becomes entrained in the respective upper and lower annular gaps 221 and 271. This cutting and shearing action in turn is effective in maintaining reliable operation of the pump 10 at high efficiency.

In accordance with the present disclosure, a self-cleaning pump may be provided with an open impeller. Referring to FIGS. 9-13, such a pump 11 is comprised of a volute housing 101, a rotatable shaft 50, and an impeller 201 formed as an open impeller. The volute housing 101 comprises a volute cavity side wall 150, an upper cylindrical wall 120, and an upper wall 110. The volute cavity side wall 150 defines a volute cavity 155, and includes an upper region 152 terminating at an upper perimeter edge 153. The upper cylindrical wall 120 extends upwardly from the upper perimeter edge 153 and includes an upper recessed notch 160 formed therein. The upper wall 110 extends radially inwardly from the upper cylindrical wall 120.

Figure 2:
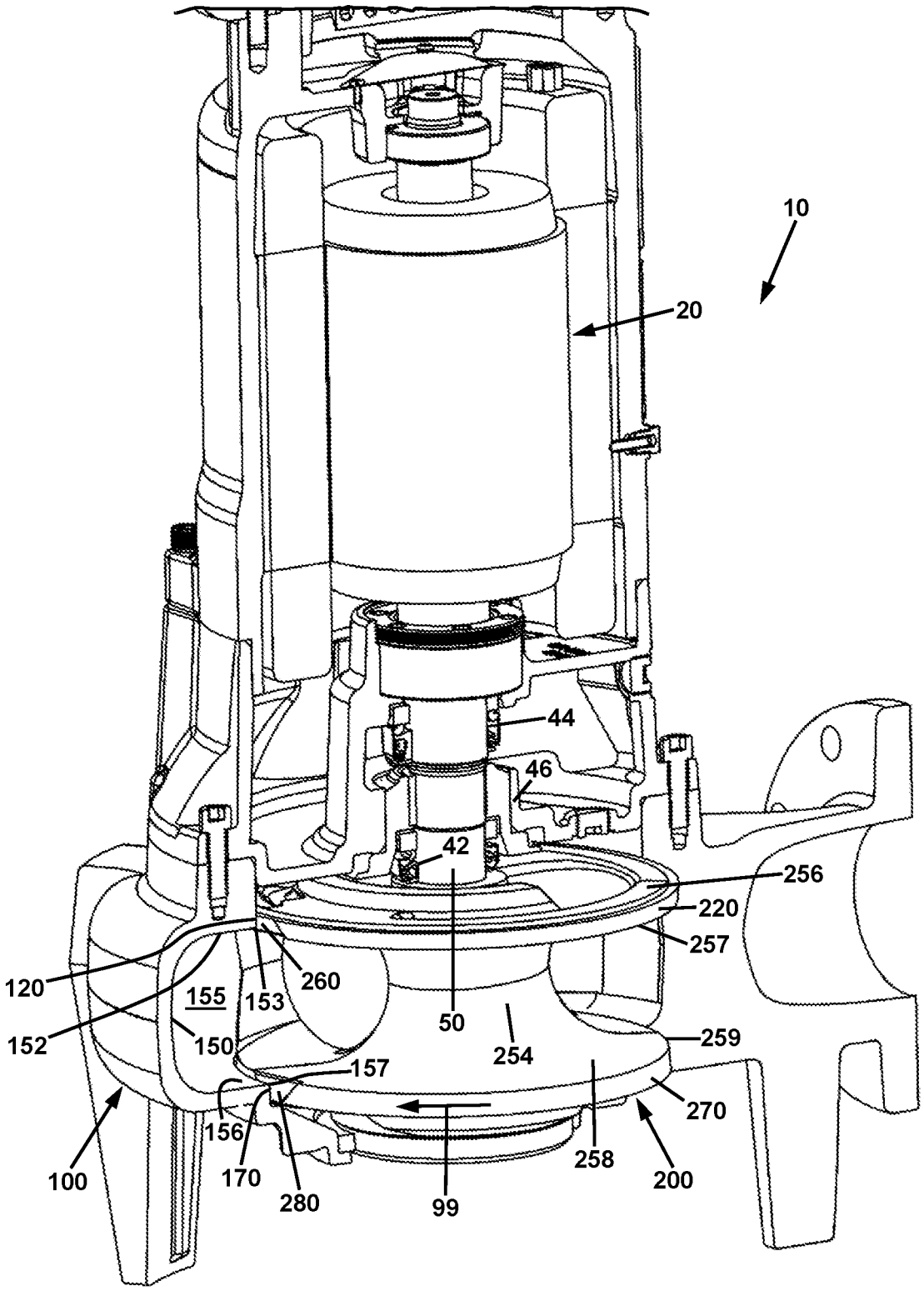
FIG. 2 is a cutaway perspective view of the pump of FIG. 1.
Figure 3:
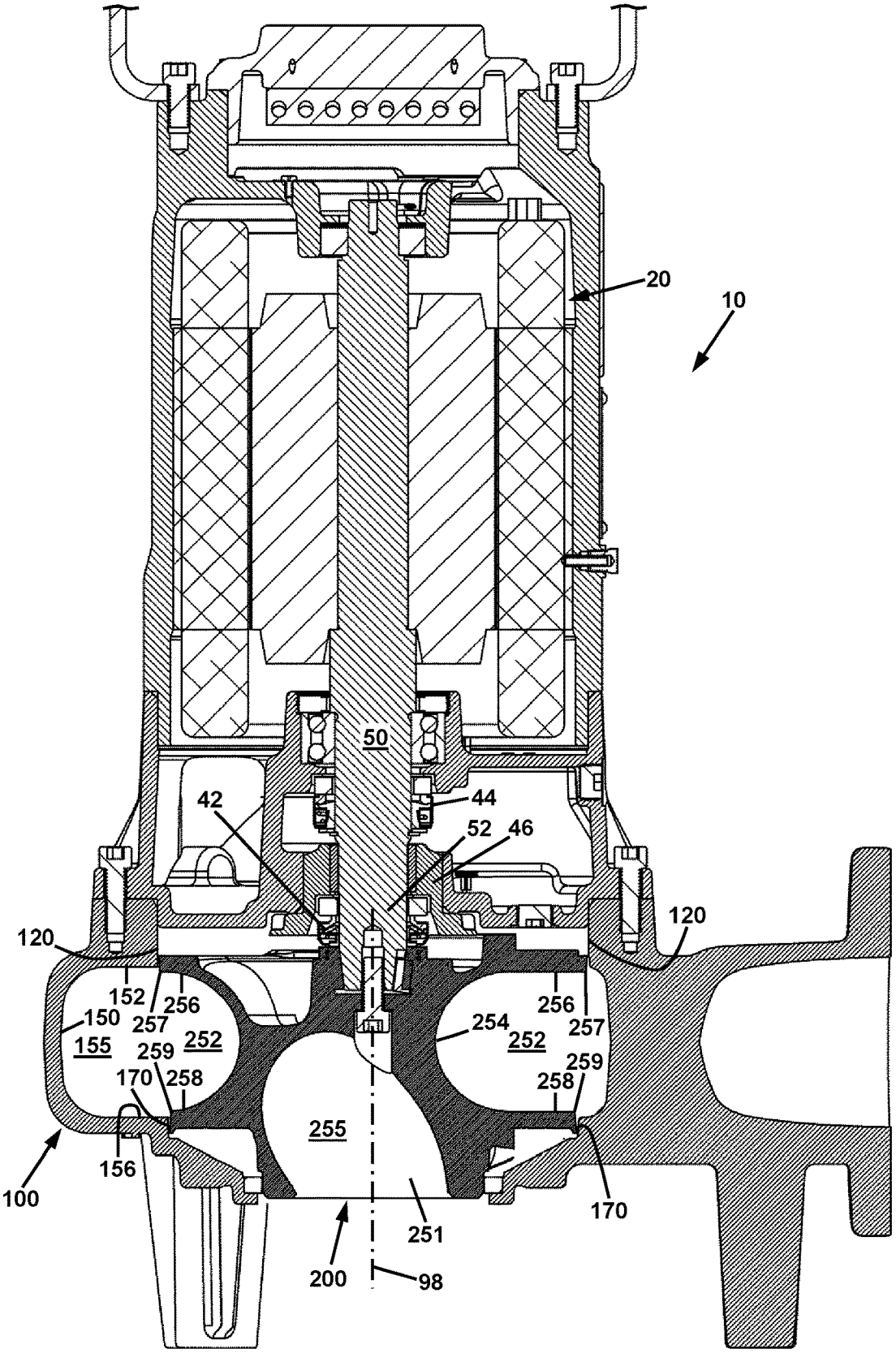
FIG. 3 is a side cross-sectional view of the pump taken along line 3-3 of FIG. 1.
Figure 4A:
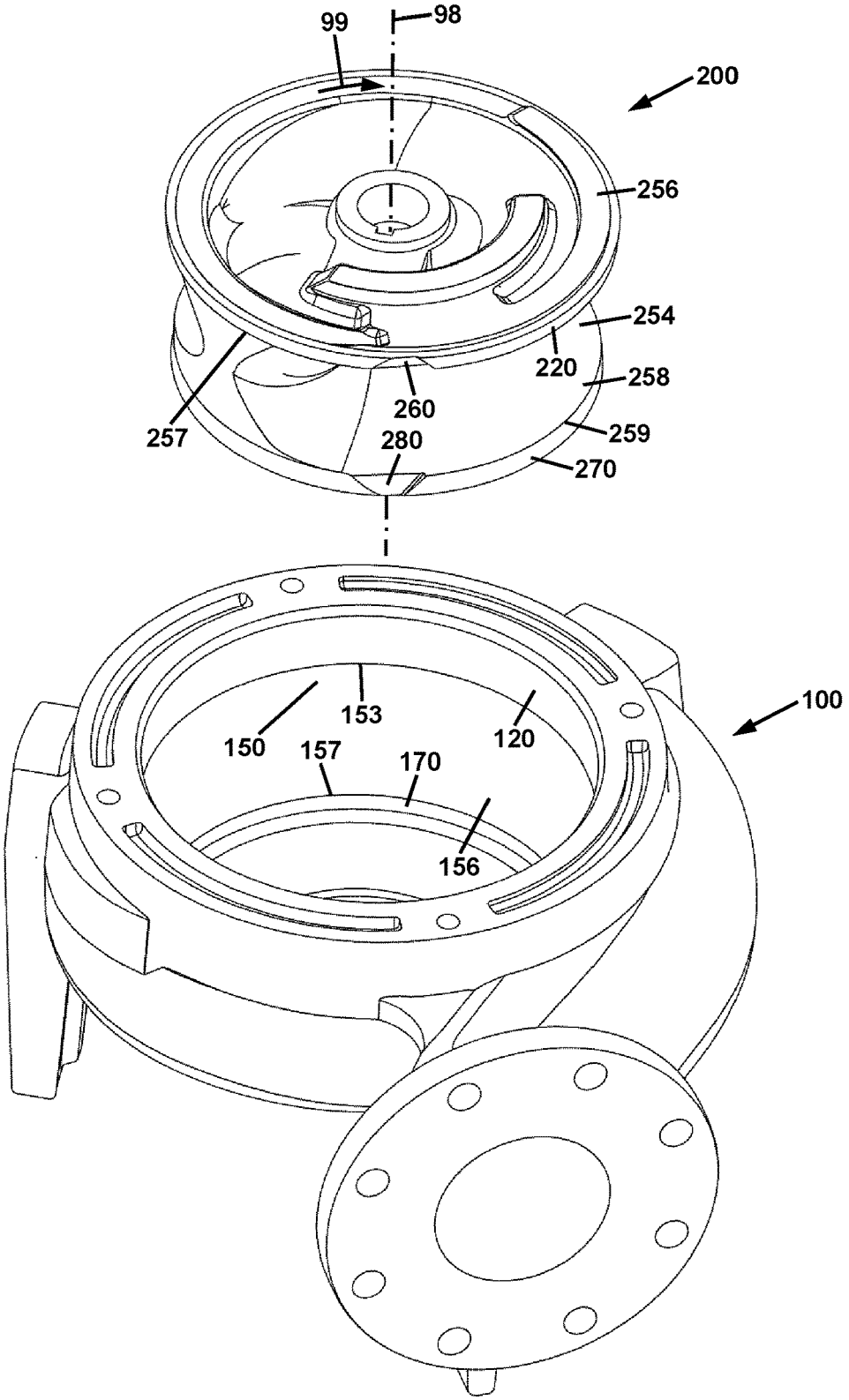
FIG. 4A is a first exploded perspective view of a volute and impeller of the pump of FIG. 1.
Figure 4B:
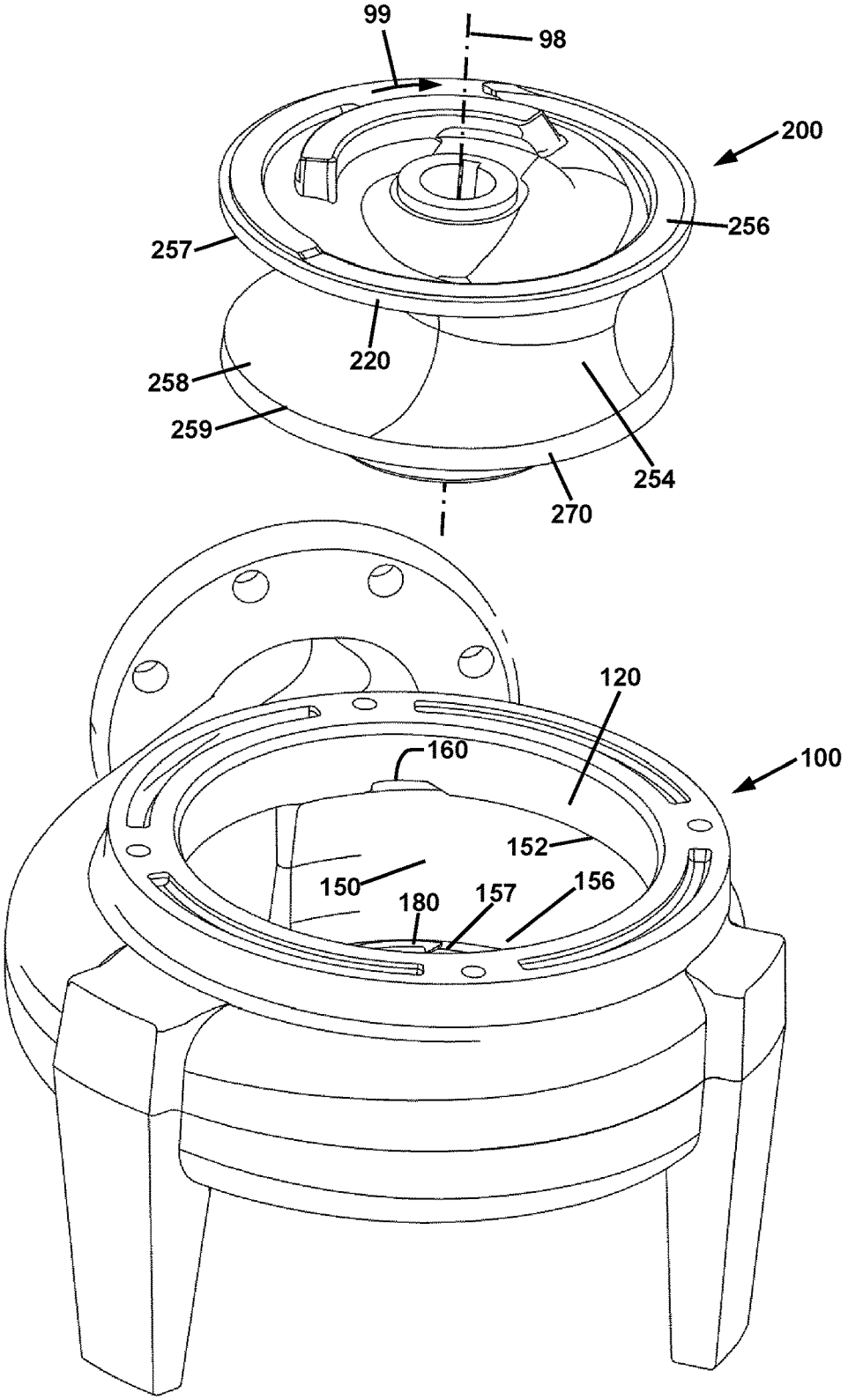
FIG. 4B is a second exploded perspective view of the volute and impeller of the pump of FIG. 1.
Figure 5A:
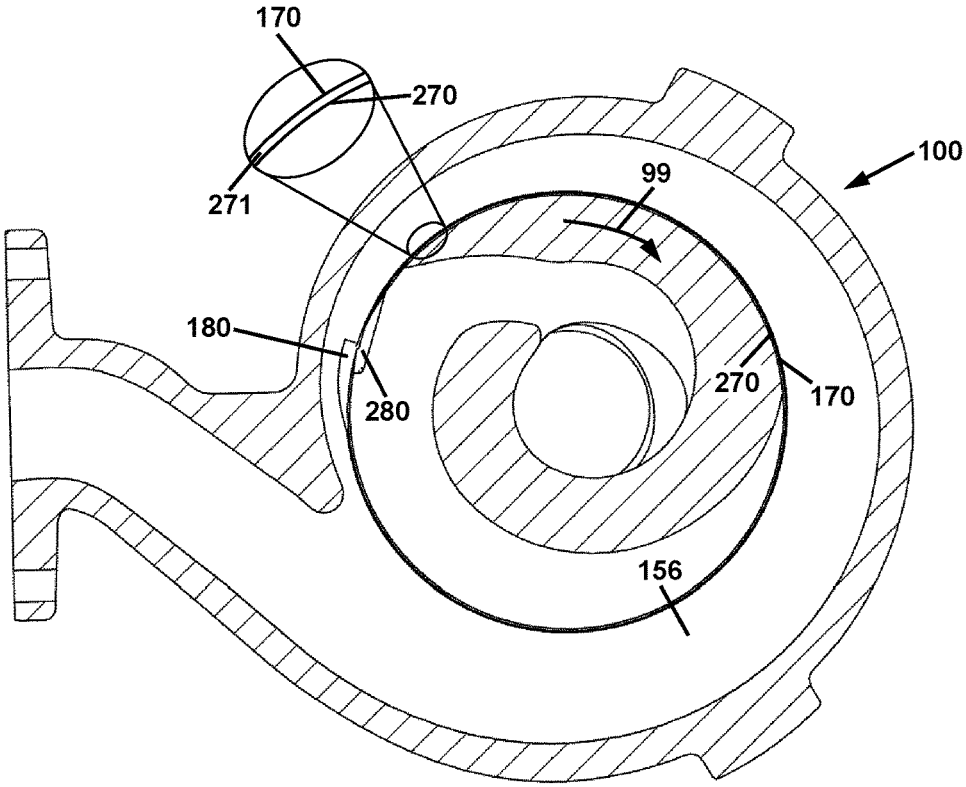
FIG. 5A is a first top cross-sectional view of the impeller and volute of the pump taken along line 5A-5A of FIG. 1, which defines a horizontal plane through a volute cavity side wall of a volute housing of the pump.
Figure 5B:
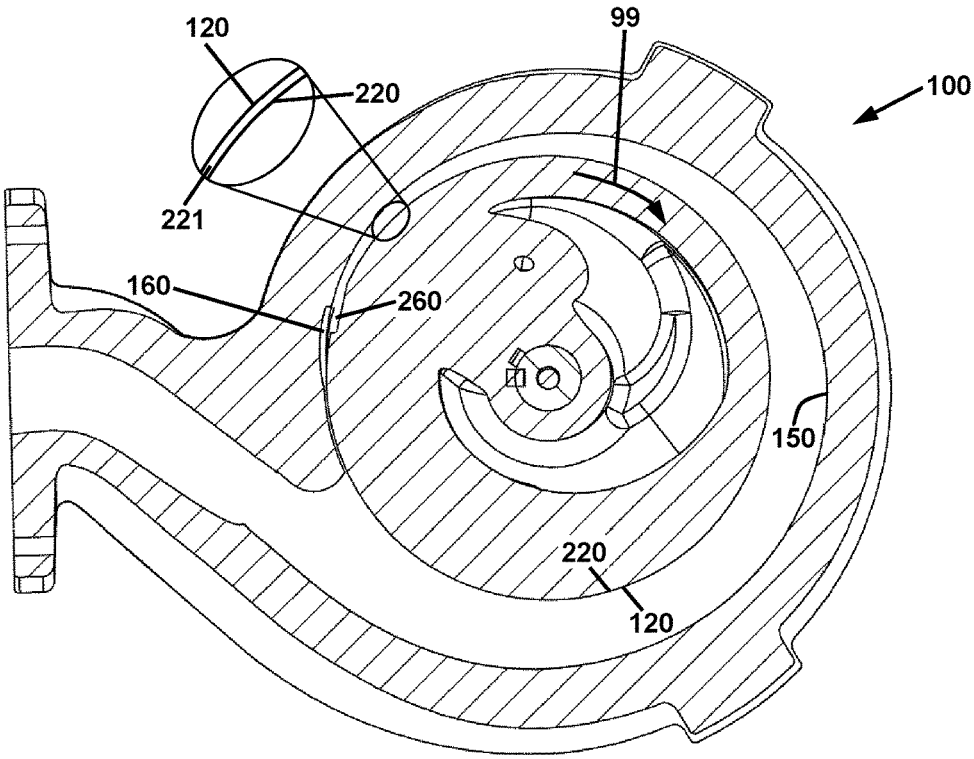
FIG. 5B is a second top cross-sectional view of the impeller and volute housing of the pump taken along line 5B-5B of FIG. 1, which defines a horizontal plane through an upper cylindrical wall of the volute housing of the pump.
Figure 6A:
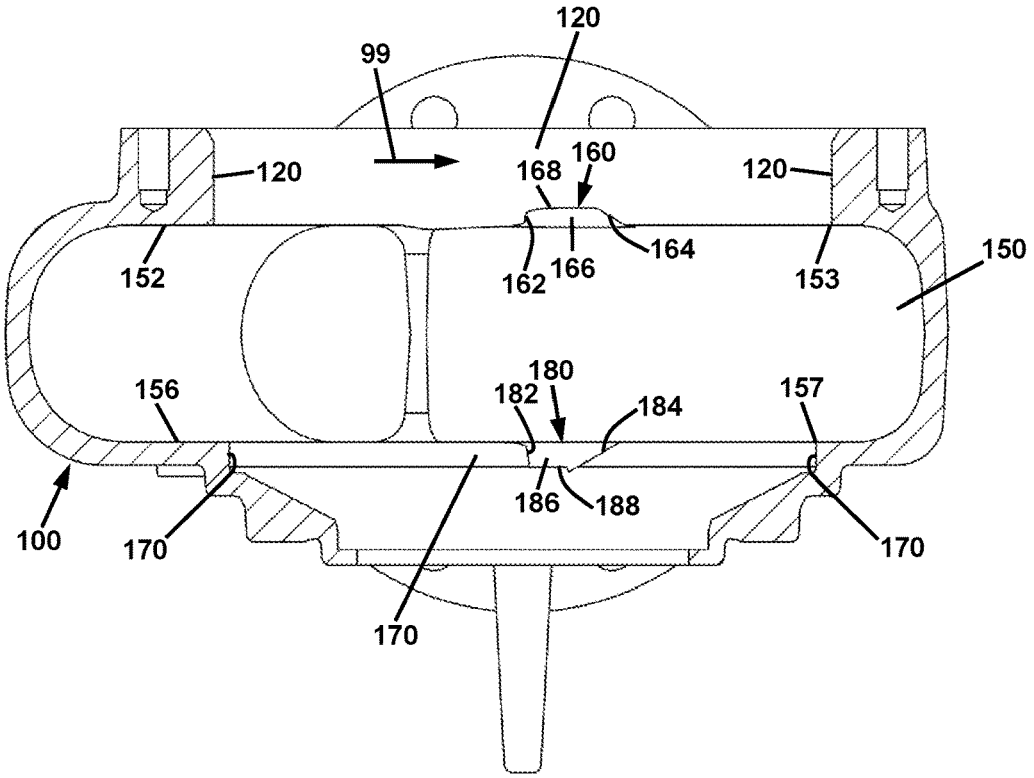
FIG. 6A is a first side cross-sectional view of the volute housing of the pump taken along line 6A-6A of FIG. 1 which defines a first vertical plane through a central axis of the volute housing and impeller of the pump.
Figure 6B:
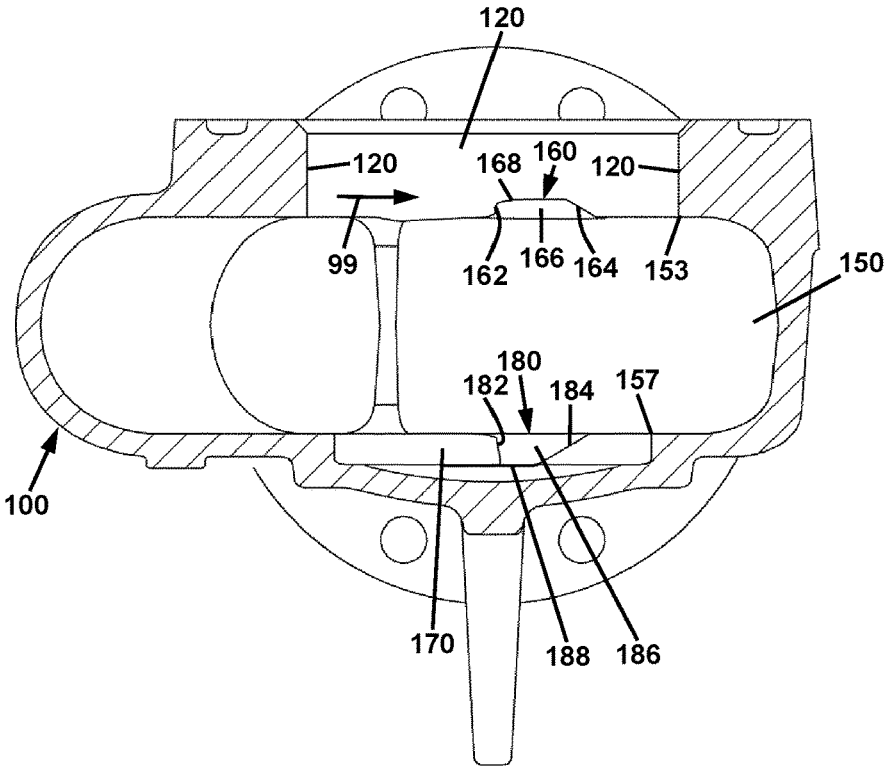
FIG. 6B is a second side cross-sectional view of the volute housing of the pump taken along line 6B-6B of FIG. 1 which defines a second vertical plane through a lateral region of the volute housing of the pump.

The rotatable shaft 50 may be driven by a motor 20 or other suitable means, as previously described for pump 10 of FIGS. 1-3. The rotatable shaft 50 extends to the upper wall 110 of the volute housing 101 and terminates at a distal end 52. The rotatable impeller 201 is operatively coupled to the rotatable shaft 50 and has a direction of rotation 99 and an axis of rotation 98. Sealing between the rotary shaft 50 and the volute housing 101 may be provided by seals 42 and 44, and bushing 46, as previously described for pump 10 of FIGS. 1-3.

The rotatable impeller 201 is comprised of a top cylindrical wall 220, a top flange 256, and vanes 253. The top cylindrical wall 220 extends upwardly from a top perimeter edge 257 of the top flange 256 and includes a top recessed notch 260 formed therein. The top cylindrical wall 220 is separated from the upper cylindrical wall 120 of the volute housing 101 by an upper annular gap 221 in the same manner as previously described for volute housing 100 and impeller 200 of pump 10. (See FIG. 5B.)

The top recessed notch 260 of the rotatable impeller 201 and the upper recessed notch 160 of the volute housing 101 may be slot-shaped or wedge-shaped as described above for the volute 100 of pump 10 and subsequently herein. In operation of the pump 11, rotation of the rotatable shaft 50 causes rotational motion of the top recessed notch 260 of the top cylindrical wall 220 of the impeller 201 past the upper recessed notch 160 of the upper cylindrical wall 120 of the volute housing 101. Such motion of the top recessed notch 260 of the top cylindrical wall 220 of the impeller 200 past the upper recessed notch 160 of the upper cylindrical wall 120 of the volute housing 100 results in a shearing action when the notch pairs 160/260 pass each other. The shearing action has been discovered to be effective in cutting and discharging any debris that becomes entrained in the upper annular gap 221. This cutting and shearing action in turn is effective in maintaining reliable operation of the pump 11 at high efficiency.

Figure 8:
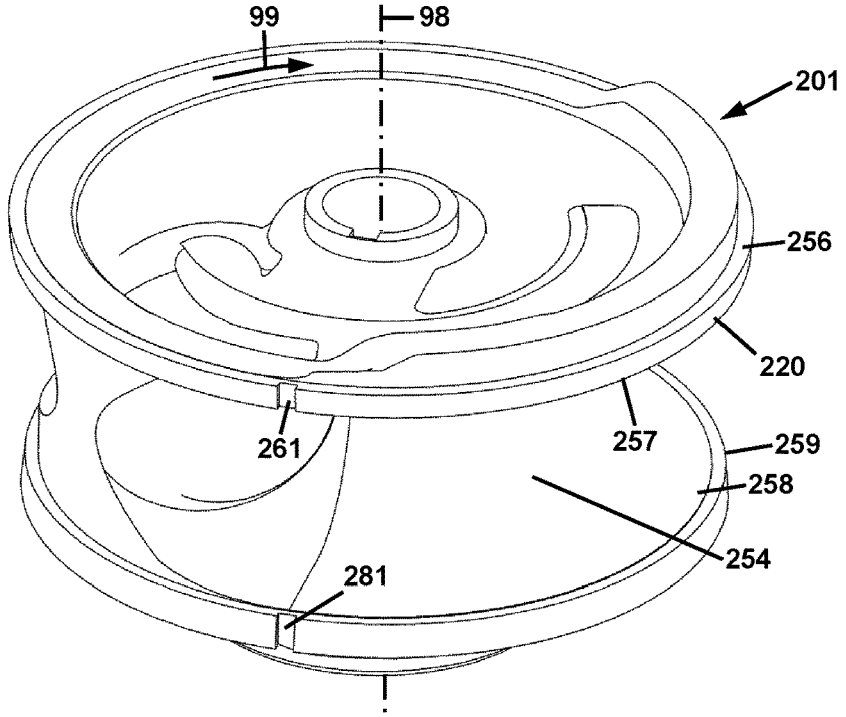
FIG. 8 is an upper perspective view of an alternative embodiment of an impeller of the pump, depicting alternative notches in the cylindrical walls of the impeller.
Figure 9:
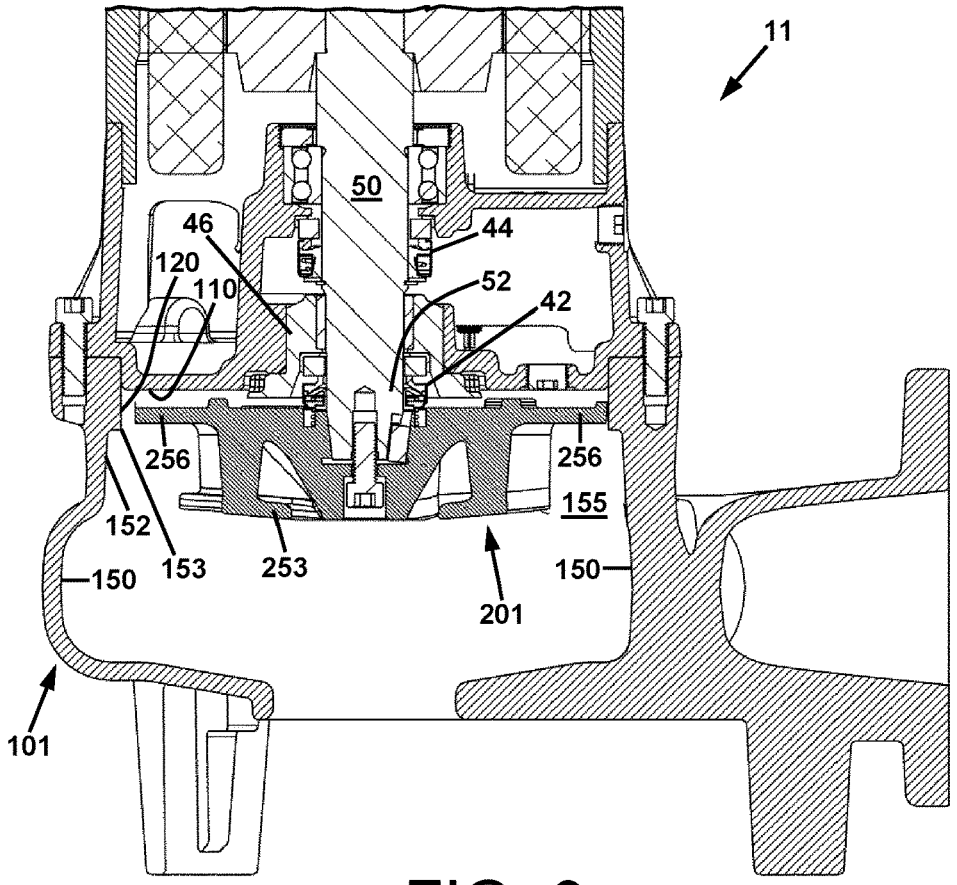
FIG. 9 is a is a side cross-sectional view of an alternative pump taken along line 3-3 of FIG. 1, the alterative pump including an open impeller.

The Applicant has discovered that for both the closed impeller pump 10 and the open impeller pump 11, various notch configurations are effective in cutting and discharging entrained debris in the annular gaps between the volute housing and the impeller. Referring to FIG. 8, an alternative impeller 201 that includes simple rectangular notches 261 and 281 provide effective cutting and discharging action. The Applicant believes that as the notches 261 and 281 rotationally traverse along the annular gaps 221 and 271, they accumulate solid particles of debris and/or snag stringy debris fragments, and convey them to the corresponding notches 160 and 180 in the volute housing. This conveying action occurs in spite of the fact that the width of the annular gap varies around its circumference because unless by a chance "perfect" concentric match, the impeller 200 does not run exactly concentrically within the volute housing due to manufacturing tolerance variations. Thus the Applicant's impeller 200 and volute housing 100 operate jam-free and in a self-cleaning manner in spite of non-concentric operation.

The Applicant has further discovered that wedge-shaped notches in the volute housing 100 and in the impeller 200 are more effective in receiving and discharging solid debris from the annular gaps 221 and 271. This is best understood with reference to FIGS. 3A-7C, and FIGS. 10-13.

Figure 7A:
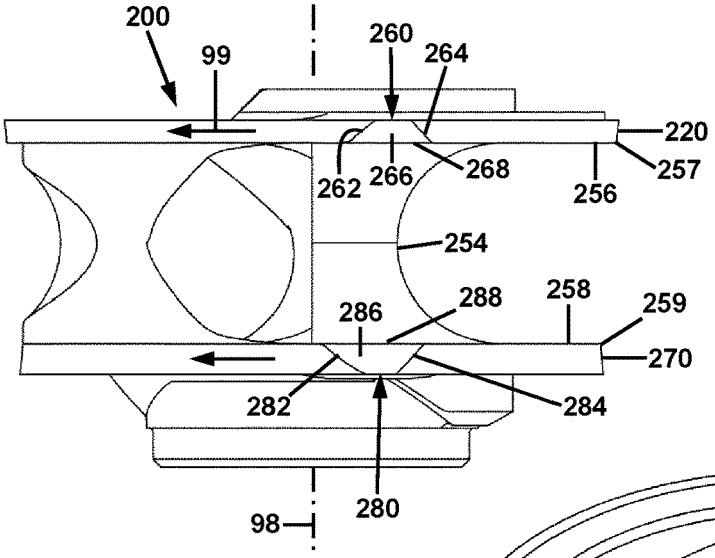
FIG. 7A is a side elevation view of one embodiment of the impeller of the pump, depicting notches in the cylindrical walls of the impeller.
Figure 7B:
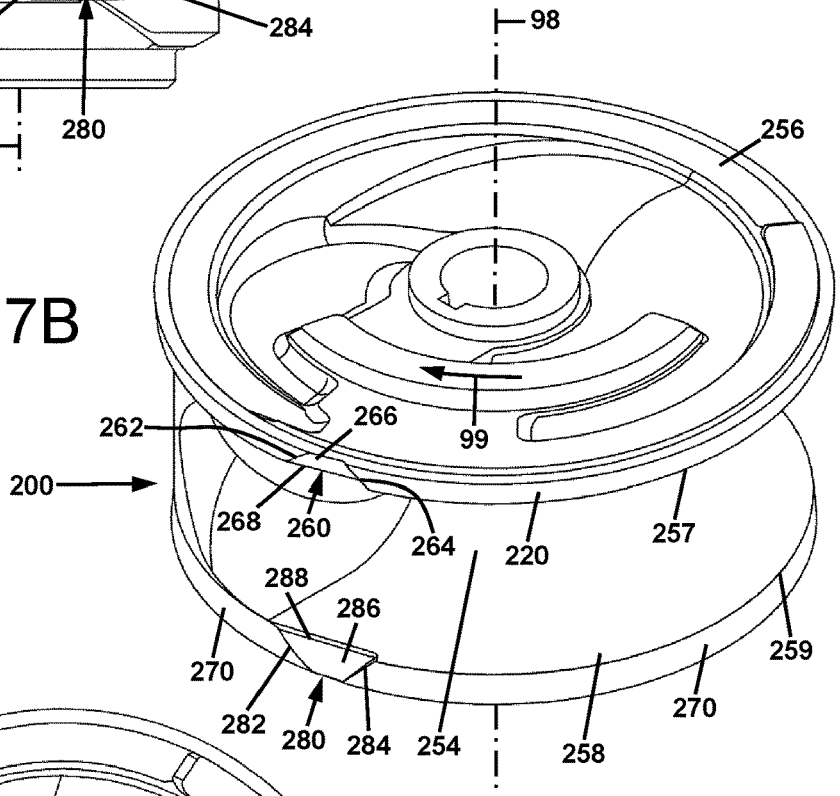
FIG. 7B is an upper perspective view of the impeller of FIG. 7A.
Figure 7C:
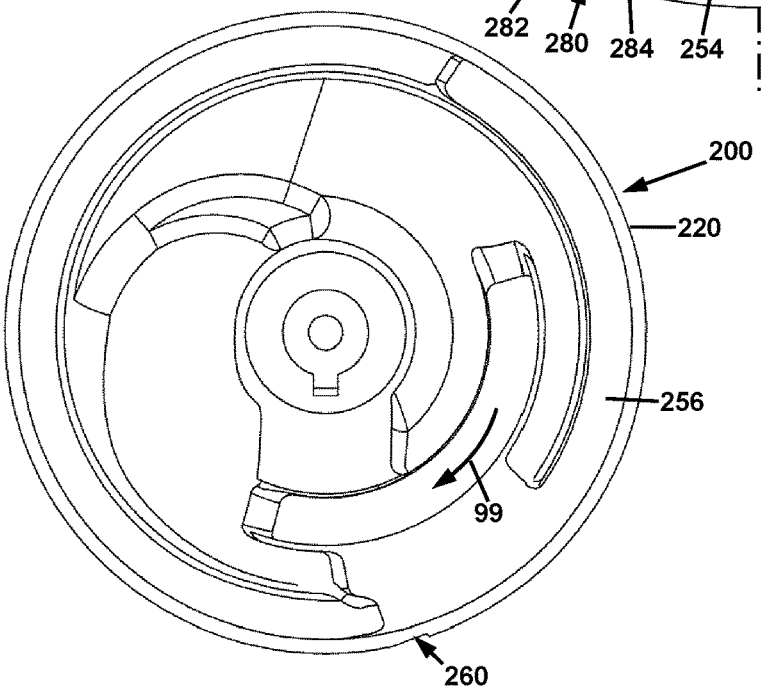
FIG. 7C is a top view of the impeller of FIG. 7A.

Turning first to the impeller notch embodiments of the pump 10 of FIGS. 7A-7C, the impeller 200 includes top and bottom wedge shaped notches 260 and 280. The top notch 260 is comprised of a leading wall 262 at a first angle relative to the direction of impeller rotation 99, a trailing wall 264 at a second angle relative to the direction of impeller rotation 99, a side wall 266, and a bottom edge 268. The leading wall 262 may be tilted from top to bottom at an acute angle in the direction of rotation 99 and relative to the axis of rotation 98. The trailing wall 264 may be tilted at an acute angle from top to bottom counter to the direction of rotation 99 and relative to the axis of rotation 98. The side wall 266 may be tilted from the bottom edge 268 at an acute angle radially outwardly relative to the axis of rotation 98. (This is illustrated most clearly by considering the top view shown in FIG. 7C, where the notch 260 is barely visible, while in the perspective view in FIG. 7B, the notch 260 has considerable depth.)

In like manner, the impeller bottom notch 280 is comprised of a leading wall 282 at a first angle relative to the direction of impeller rotation 99, a trailing wall 284 at a second angle relative to the direction of impeller rotation 99, a side wall 286, and a top edge 288. The walls of bottom notch 280 may be tilted from bottom to top relative to the direction of rotation 99 and the axis of rotation 98 as described for top notch 260.

Referring to FIGS. 4B-6B, the volute housing 100 includes upper and lower wedge shaped notches 160 and 180. The upper notch 160 is comprised of a leading wall 162 at a first angle relative to the direction of impeller rotation 99, a trailing wall 164 at a second angle relative to the direction of impeller rotation 99, a side wall 166, and a bottom edge 168. The leading wall 162 may be tilted from top to bottom at an acute angle counter to the direction of rotation 99 and relative to the axis of rotation 98. The trailing wall 164 may be tilted at an acute angle from top to bottom in the direction of rotation 99 and relative to the axis of rotation 98. The side wall 166 may be tilted from the bottom edge 168 at an acute angle radially inwardly relative to the axis of rotation 98.

In like manner, the volute housing lower notch 180 is comprised of a leading wall 182 at a first angle relative to the direction of impeller rotation 99, a trailing wall 184 at a second angle relative to the direction of impeller rotation 99, a side wall 186, and a top edge 188. The walls of lower notch 180 may be tilted relative to the direction of rotation 99 and the axis of rotation 98 as described for top notch 260.

In certain embodiments, the impeller and volute housing may have alternative wedge-shaped notches. Referring to FIGS. 10-12C, an alternative top notch 263 of an impeller 100 or 101 is comprised of a side wall 265 and a trailing wall 267. The side wall 265 extends counter to the direction of rotation 99 from a leading edge 269 contiguous with the top cylindrical wall 220 of the impeller 201 to a trailing edge 273, which also forms the inner edge of the trailing wall 267. The trailing wall 267 may be tilted from top to bottom at an acute angle counter to the direction of rotation 99 and relative to the axis of rotation 98.

Figure 10:
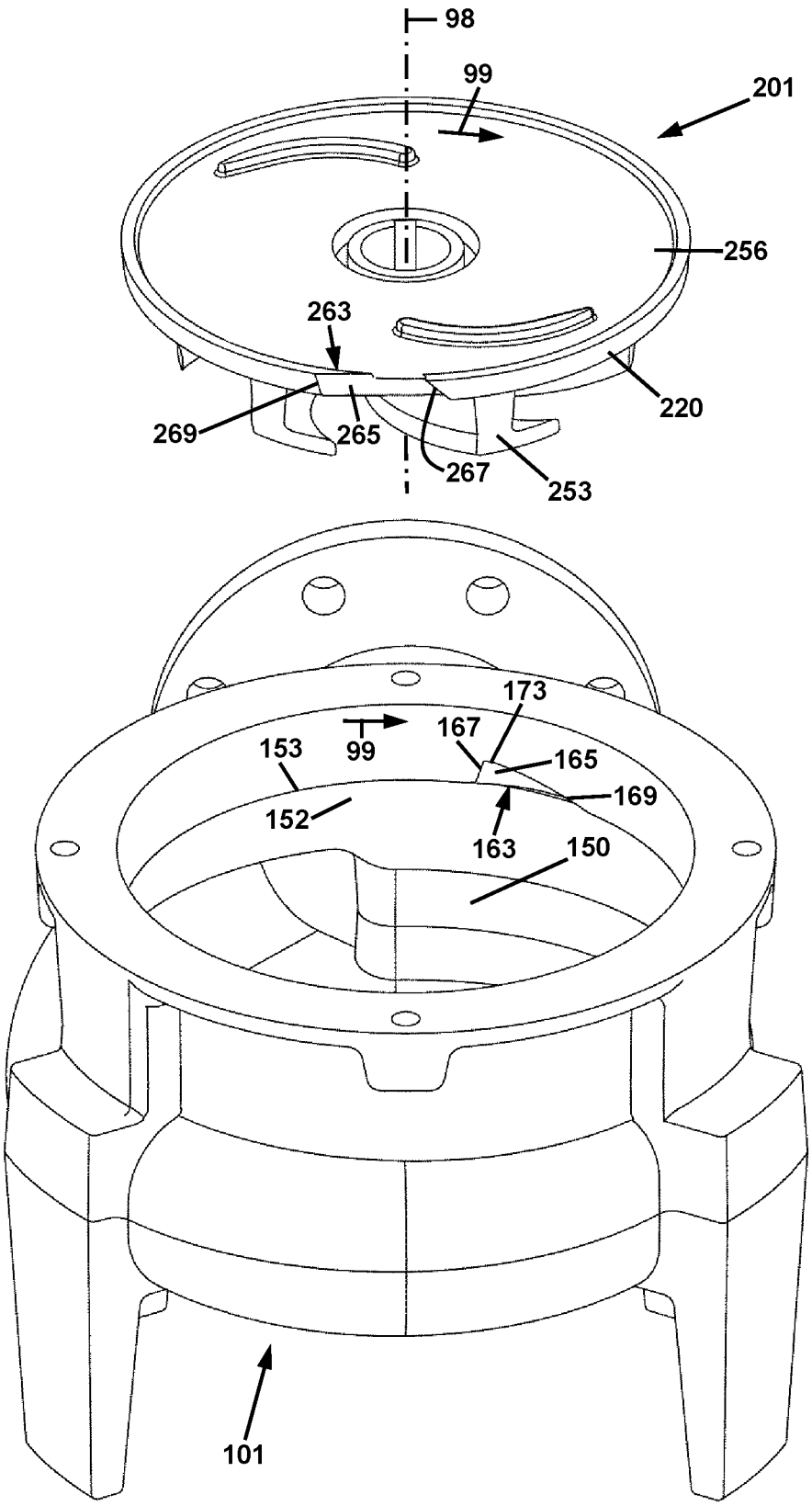
FIG. 10 is an exploded upper perspective view of a volute and impeller of the pump of FIG. 9.
Figure 11:
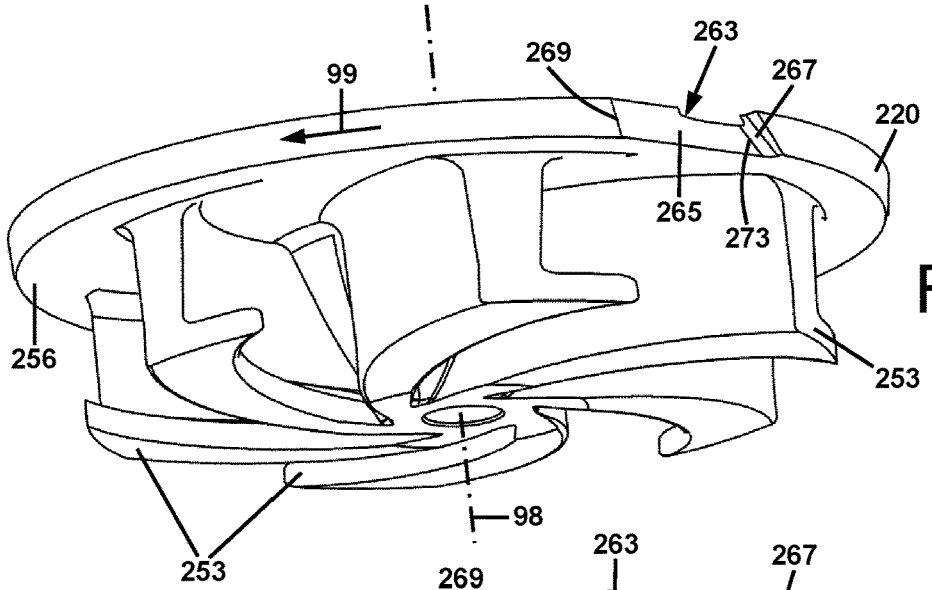
FIG. 11 is a lower perspective view of the impeller of the pump of FIG. 9.
Figure 12A:
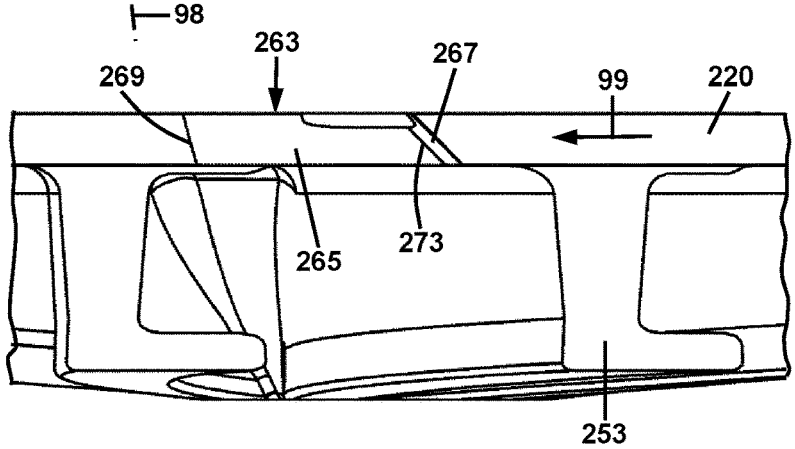
FIG. 12A is a detailed side elevation view of a wedge-shaped notch of the impeller of FIG. 11.
Figure 12B:
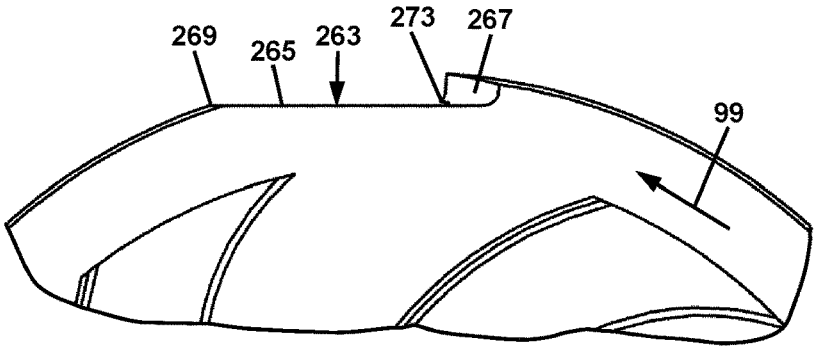
FIG. 12B is a detailed bottom view of a wedge-shaped notch of the impeller of FIG. 11.
Figure 12C:
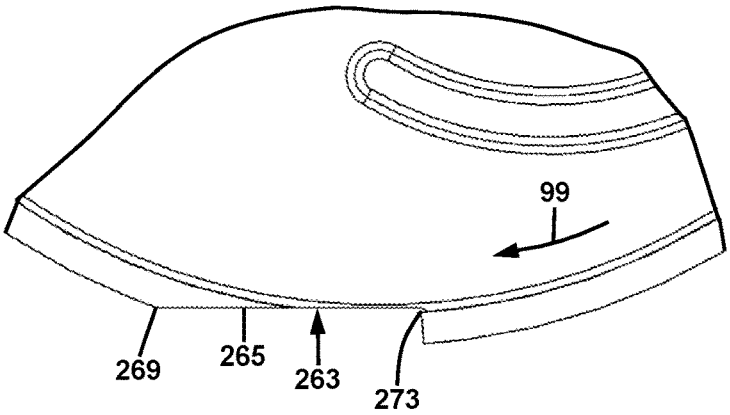
FIG. 12C is a detailed top view of a wedge-shaped notch of the impeller of FIG. 11.
Figure 13:
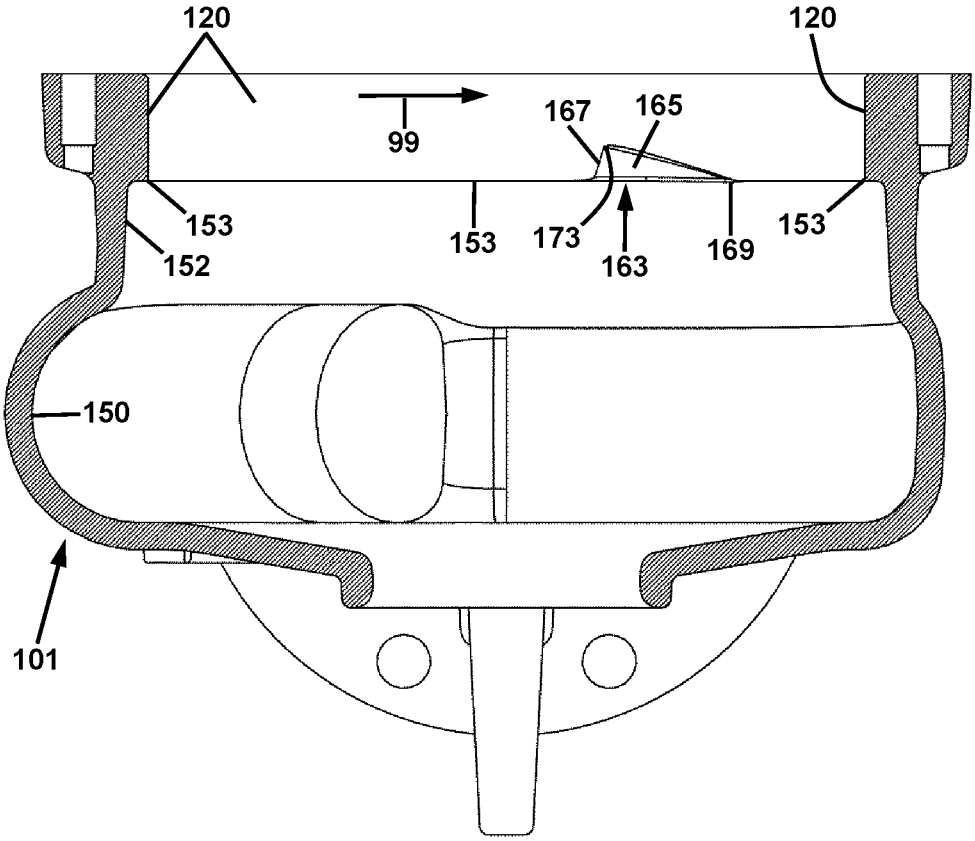
FIG. 13 is a side cutaway view of the volute of the pump of FIG. 9.

Referring to FIGS. 10 and 13, an alternative upper notch 163 of a volute housing 100 or 101 is comprised of a side wall 165 and a leading wall 167. The side wall 165 extends in the direction of rotation 99 from an inner edge 173 to a trailing edge 169 contiguous with the upper cylindrical wall 120 of the volute housing 10. The inner edge 173 also forms the inner edge of the leading wall 167. The leading wall 167 may be tilted from top to bottom at an acute angle counter to the direction of rotation 99 and relative to the axis of rotation 98.

It is therefore apparent that there has been provided, in accordance with the present disclosure, a self-cleaning pump. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

To the extent that other references may contain similar information in the Background herein, said statements do not constitute an admission that those references are prior art or have any relevance to the patentability of the technology disclosed herein. Any discussion in the Background is intended merely to provide a general summary of assertions.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

To the extent employed herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

Unless otherwise specified, relational terms used in the present disclosure should be construed to include certain tolerances that those skilled in the art would recognize as providing equivalent functionality. By way of example, the term perpendicular is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

As used herein, the words "comprise," "include," contain," and variants thereof are intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

In the following description, numerous details are set forth to provide an understanding of the disclosed apparatus and methods. However, it will be understood by those skilled in the art that the apparatus and methods covered by the claims may be practiced without these details and that numerous variations or modifications from the specifically described embodiments may be possible and are deemed within the claims.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

We claim:

1. A pump comprising:

a) a volute housing comprising:

a volute cavity side wall defining a volute cavity and including an upper region terminating at an upper perimeter edge and a lower region terminating at a lower perimeter edge;

an upper cylindrical wall located at an upper axial location and extending upwardly from the upper perimeter edge and including an upper recessed notch formed therein; and a lower cylindrical wall located at a lower axial location and extending downwardly from the lower perimeter edge and including a lower recessed notch formed therein;

b) a rotatable shaft extending proximate to the volute cavity of the volute housing and terminating at a distal end;

c) a rotatable impeller operatively coupled to the rotatable shaft, having a direction of rotation and an axis of rotation, and comprising:

an impeller side wall;

a top flange comprising a top outer perimeter edge contiguous with the impeller side wall and a top cylindrical wall located at the upper axial location and extending upwardly from the top outer perimeter edge and including a top recessed notch formed therein, the top cylindrical wall separated from the upper cylindrical wall of the volute housing by an upper annular gap; and a bottom flange comprising a bottom outer perimeter edge contiguous with the impeller side wall and a bottom cylindrical wall located at the lower axial location and extending downwardly from the bottom outer perimeter edge and including a bottom recessed notch formed therein, the bottom cylindrical wall separated from the lower cylindrical wall of the volute housing by a lower annular gap;

wherein during a rotation of the impeller, the top recessed notch of the top flange of the impeller temporarily overlaps the upper recessed notch of the upper cylindrical wall of the volute housing and the bottom recessed notch of the bottom flange of the impeller temporarily overlaps the lower recessed notch of the lower cylindrical wall of the volute housing.

2. The pump of claim 1, wherein rotation of the rotatable shaft causes rotational motion of the top recessed notch of the top cylindrical wall of the impeller past the upper recessed notch of the upper cylindrical wall of the volute housing and rotational motion of the bottom recessed notch of the bottom cylindrical wall of the impeller past the lower recessed notch of the lower cylindrical wall of the volute housing.

3. The pump of claim 1, wherein the rotatable impeller is further comprised of an impeller passageway in fluid communication with the volute cavity and including an axial inlet transitioning to a lateral outlet defined by the side wall, the top flange, and the bottom flange.

4. The pump of claim 1, wherein the top and bottom recessed notches of the impeller are slot-shaped.

5. The pump of claim 4, wherein the upper and lower recessed notches of the volute housing are slot-shaped.

6. The pump of claim 1, wherein the top and bottom recessed notches of the impeller are wedge-shaped.

7. The pump of claim 6, wherein the upper and lower recessed notches of the volute housing are wedge-shaped.

8. The pump of claim 6, wherein each of the top and bottom recessed notches of the impeller is comprised of a leading wall at a first angle relative to the direction of impeller rotation, and a trailing wall at a second angle relative to the direction of impeller rotation.

9. The pump of claim 8, wherein each of the top and bottom recessed notches of the impeller is comprised of a side wall.

10. The pump of claim 9, wherein the side wall of each of the top and bottom recessed notches is formed at an acute angle relative to the axis of rotation of the impeller.

11. A pump comprising:

a) a volute housing comprising a volute cavity side wall defining a volute cavity and including an upper region terminating at an upper perimeter edge, and an upper cylindrical wall located at an upper axial location and extending upwardly from the upper perimeter edge and including an upper recessed notch formed therein;

b) a rotatable shaft extending proximate to the volute cavity of the volute housing and terminating at a distal end; and c) a rotatable impeller operatively coupled to the rotatable shaft, having a direction of rotation and an axis of rotation, and comprising a top flange extending radially outwardly away from the axis of rotation and comprised of a top cylindrical wall located at the upper axial location and extending upwardly from the top perimeter edge of the top flange and defining a maximum outer perimeter of the impeller; the top cylindrical wall including a top recessed notch formed therein; and the top cylindrical wall separated from the upper cylindrical wall of the volute housing by an upper annular gap;

wherein during a rotation of the impeller, the top recessed notch of the top flange of the impeller temporarily overlaps the upper recessed notch of the upper cylindrical wall of the volute housing.

12. The pump of claim 11, wherein rotation of the rotatable shaft causes rotational motion of the top recessed notch of the top cylindrical wall of the impeller past the upper recessed notch of the upper cylindrical wall of the volute housing.

13. The pump of claim 11, wherein the top recessed notch of the impeller is slot-shaped.

14. The pump of claim 13, wherein the upper recessed notch of the volute housing is slot-shaped.

15. The pump of claim 11, wherein the top recessed notch of the impeller is wedge-shaped.

16. The pump of claim 15, wherein the upper recessed notch of the volute housing is wedge-shaped.

17. The pump of claim 15, wherein the top recessed notch of the impeller is comprised of a leading wall at a first angle relative to the direction of impeller rotation, and a trailing wall at a second angle relative to the direction of impeller rotation.

18. The pump of claim 17, wherein the top recessed notch of the impeller is comprised of a side wall.

19. The pump of claim 18, wherein the side wall of the top recessed notches is formed at an acute angle relative to the axis of rotation of the impeller.

* * * * *